US009915033B2

(12) United States Patent
Hermans et al.

(10) Patent No.: US 9,915,033 B2
(45) **Date of Patent: *Mar. 13, 2018**

(54) SMOOTH BULKY TISSUE

(71) Applicant: Kimberly-Clark Worldwide, Inc., Neenah, WI (US)

(72) Inventors: Michael Alan Hermans, Neenah, WI (US); Samuel August Nelson, Menasha, WI (US); Paulin Pawar, Appleton, WI (US); Jeffrey James Timm, Menasha, WI (US); Kyle Andrew Krautkramer, Kaukauna, WI (US); Robert Eugene Krautkramer, Combined Locks, WI (US); Frank Stephen Hada, Appleton, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/627,677

(22) Filed: Jun. 20, 2017

(65) Prior Publication Data

US 2017/0284029 A1 Oct. 5, 2017

Related U.S. Application Data

(63) Continuation of application No. 14/903,319, filed as application No. PCT/US2013/057091 on Aug. 28, 2013, now Pat. No. 9,714,485.

(51) Int. Cl.

| | |
|---|---|
| ***D21H 27/00*** | (2006.01) |
| ***D21H 27/40*** | (2006.01) |
| ***A47K 10/16*** | (2006.01) |
| ***B65H 18/28*** | (2006.01) |
| ***D21H 25/00*** | (2006.01) |

(52) U.S. Cl.

CPC ..... *D21H 27/005* (2013.01); *A47K 10/16* (2013.01); *D21H 25/005* (2013.01); *D21H 27/002* (2013.01); *D21H 27/40* (2013.01)

(58) Field of Classification Search

CPC .. D21H 27/005; D21H 25/005; D21H 27/002; D21H 27/40; A47K 10/16; B65H 18/28; B65H 2301/414323

See application file for complete search history.

(56) References Cited

U.S. PATENT DOCUMENTS

| | | | | |
|---|---|---|---|---|
| 5,277,761 | A | 1/1994 | Phan et al. | |
| 5,336,373 | A | 8/1994 | Scattolino et al. | |
| 5,840,403 | A | 11/1998 | Trokhan et al. | |
| 6,610,173 | B1 | 8/2003 | Lindsay et al. | |
| 6,849,157 | B2 * | 2/2005 | Farrington, Jr. | B32B 29/00 162/111 |
| 7,156,954 | B2 * | 1/2007 | Farrington, Jr. | B32B 29/00 162/111 |
| 7,377,995 | B2 | 5/2008 | Chen et al. | |
| 7,419,569 | B2 | 9/2008 | Hermans et al. | |
| 7,879,189 | B2 * | 2/2011 | Dyer | A61K 8/0208 162/112 |
| 8,481,133 | B2 * | 7/2013 | Hermans | A47K 10/16 162/118 |
| 8,652,597 | B2 * | 2/2014 | Hermans | A47K 10/16 428/153 |
| 8,834,978 | B1 * | 9/2014 | Hermans | A47K 10/16 428/153 |
| 8,852,398 | B2 * | 10/2014 | Hermans | D21H 27/30 162/109 |
| 8,940,376 | B2 * | 1/2015 | Stage | D21H 1/00 162/117 |
| 2004/0101704 | A1 | 5/2004 | Hermans et al. | |
| 2004/0140076 | A1 | 7/2004 | Hermans et al. | |
| 2004/0200590 | A1 | 10/2004 | Wilhelm | |
| 2005/0006039 | A1 * | 1/2005 | Farrington, Jr. | B32B 29/00 162/109 |
| 2005/0161179 | A1 * | 7/2005 | Hermans | D21F 11/14 162/109 |
| 2007/0044928 | A1 | 3/2007 | Shannon et al. | |
| 2007/0137808 | A1 * | 6/2007 | Lostocco | A47K 10/16 162/109 |
| 2008/0073045 | A1 * | 3/2008 | Dyer | A47K 10/16 162/112 |
| 2008/0099169 | A1 | 5/2008 | Beuther et al. | |
| 2008/0135195 | A1 * | 6/2008 | Hermans | D21H 21/18 162/135 |
| 2009/0057169 | A1 | 3/2009 | Kruchoski et al. | |
| 2009/0242154 | A1 * | 10/2009 | Beuther | B31F 1/126 162/111 |

(Continued)

FOREIGN PATENT DOCUMENTS

| | | | | |
|---|---|---|---|---|
| CA | 2921683 | A1 * | 3/2015 | A47K 10/16 |
| EP | 0 033 988 | B1 | 6/1986 | |

(Continued)

*Primary Examiner* — Jose A Fortuna

(74) *Attorney, Agent, or Firm* — Kimberly-Clark Worldwide, Inc.

(57) ABSTRACT

Creped tissue webs having low surface-roughness and high sheet bulk are disclosed. Specifically creped, single ply tissue web having a single wire probe mean deviation of MIU (MMD) of less than about 0.040 and a sheet bulk of greater than about 12 cc/g are disclosed. Additionally creped, multi-ply tissue web having a single wire probe mean deviation of MUI (MMD) of less than about 0.035 and a sheet bulk of greater than about 10 cc/g are disclosed.

15 Claims, 1 Drawing Sheet

(56) References Cited

U.S. PATENT DOCUMENTS

| | | | | |
|---|---|---|---|---|
| 2011/0129645 | A1* | 6/2011 | Dyer | A61K 8/0208<br>428/147 |
| 2013/0068868 | A1* | 3/2013 | Hermans | A47K 10/16<br>242/160.4 |
| 2013/0199741 | A1* | 8/2013 | Stage | D21H 1/00<br>162/100 |
| 2013/0269892 | A1* | 10/2013 | Hermans | A47K 10/16<br>162/111 |
| 2016/0002861 | A1* | 1/2016 | Goulet | D21H 11/04<br>162/111 |
| 2016/0145809 | A1* | 5/2016 | Hermans | A47K 10/16<br>162/111 |
| 2016/0355986 | A1* | 12/2016 | Goulet | D21H 11/04 |

FOREIGN PATENT DOCUMENTS

| | | | | |
|---|---|---|---|---|
| WO | WO 2012/059619 | A1 | 5/2012 | |
| WO | WO 2015030750 | A1 * | 3/2015 | A47K 10/16 |

* cited by examiner

SMOOTH BULKY TISSUE

RELATED APPLICATIONS

The present application is a continuation application and claims priority to U.S. patent application Ser. No. 14/903,319, filed on Jan. 7, 2016, now U.S. Pat. No. 9,714,485, which is a national-phase entry, under 35 U.S.C. § 371, of PCT Patent Application No. PCT/US13/57091, filed on Aug. 28, 2013, all of which are incorporated herein by reference.

BACKGROUND OF THE DISCLOSURE

Uncreped throughdried tissue sheet manufacturing methods are capable of extremely high production rates when producing tissue sheets. Softness is achieved by proper selection of fibers, layering, rush transfer, high-topography throughdrying fabrics and heavy calendaring to produce the resulting tissue sheet. Much of the bulk realized on the tissue machine is lost during calendaring. By comparison, conventional creped throughdried tissue sheets are generally soft but lack the bulk, acceptable lint levels and processing flexibility associated with uncreped throughdried processes.

In the manufacture of rolled, creped tissue products such as bathroom tissue and paper towels, a wide variety of product characteristics must be given attention in order to provide a final tissue product with the appropriate blend of attributes suitable for the product's intended purposes. Improving the softness of tissues is a continuing objective in tissue manufacture, especially for premium products. Softness, however, is a perceived property of tissues comprising many factors including thickness and smoothness, that is, low surface-roughness, and flexibility. Generally, higher softness is perceived with high basis weight webs due to the increased thickness of the tissue sheet. In turn, as the basis weight of the tissue sheet is increased, achieving high sheet bulk becomes more challenging since much of the bulk of the tissue structure is achieved by molding of the embryonic tissue web into the papermaking fabric and this bulk is decreased by increasing the basis weight of the sheet. Thus, there remains a need for creped tissue sheets having low surface-roughness and improved bulk at low basis weights.

When the creped tissue sheet is formed into a rolled product, the tissue sheet tends to lose a noticeable amount of bulk due to the compressive forces that are exerted on the base web during winding and converting. As such, a need currently exists for a spirally wound tissue product that can maintain a significant amount of roll bulk, sheet bulk and sheet softness even when the product is wound to produce a roll having consumer desired firmness. A firm roll conveys superior product quality and a large diameter conveys sufficient material to provide value for the consumer. From the standpoint of the tissue manufacturer, however, providing a firm roll having a large diameter is a challenge. In order to provide a large diameter roll, while maintaining an acceptable cost of manufacture, the tissue manufacturer must produce a finished tissue roll having higher roll bulk. One means of increasing roll bulk is to wind the tissue roll loosely. Loosely wound rolls however, have low firmness and are easily deformed, which makes them unappealing to consumers. Hence, there also remains a need for rolled, creped tissue products to have high roll bulk and good roll firmness.

SUMMARY OF THE DISCLOSURE

The present inventors have surprisingly discovered that by utilizing high topography papermaking fabrics and registered creping techniques that creped tissue webs, and products made therefrom, may be produced that are both smooth and have high bulk. Generally smoothness is referred to herein as the mean deviation of MIU (MMD) using the KES Surface Test, described in detail below, while bulk may refer to the bulk (measured as the inverse of density) of the tissue web, or the resulting tissue product or roll. Not only have the present inventors produced creped tissue webs and products having high surface smoothness and high bulk, but also rolled tissue products having desirable firmness.

Accordingly, in an embodiment, the present disclosure provides a rolled tissue product comprising a single ply creped tissue web spirally wound into a roll. The tissue web has a single wire probe mean deviation of MIU (MMD) of less than about 0.040. The tissue web also has a sheet bulk of greater than about 12 cc/g.

In another embodiment, the present disclosure provides a rolled tissue product comprising a multi-ply creped tissue web spirally wound into a roll. The tissue web has a single wire probe mean deviation of MUI (MMD) of less than about 0.035. The tissue web also has a sheet bulk of greater than about 10 cc/g.

In yet another embodiment, the present disclosure provides a rolled tissue product comprising a two ply tissue web spirally wound into a roll. The tissue web has a first creped tissue ply and a second creped tissue ply. The tissue web has a single wire probe mean deviation of MUI (MMD) of less than about 0.035 and a single wire probe mean deviation of surface thickness (SMD) of less than about 3.5 microns. The rolled tissue product has a roll bulk from about 8 to about 12 cc/g and a Kershaw roll firmness from about 3.5 to about 5.0 mm.

DEFINITIONS

Figure 1:
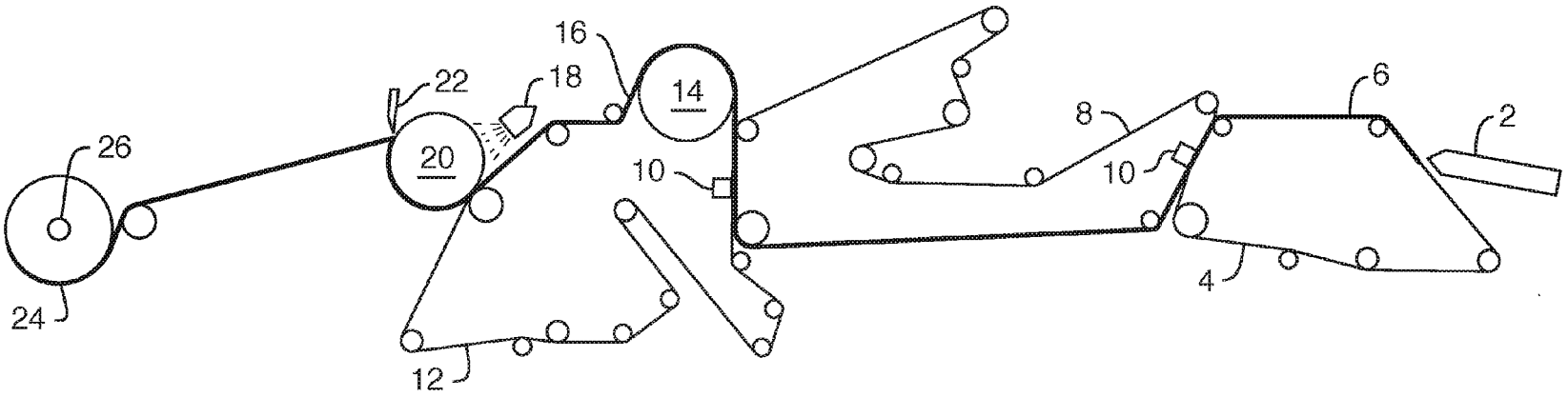
FIG. 1 is a schematic diagram of one embodiment of a process for forming a creped tissue product of the present disclosure.

"Tissue product" refers herein to products made from tissue base sheets comprising fibers and includes, bath tissues, facial tissues, paper towels, industrial wipers, foodservice wipers, napkins, medical pads, and other similar products.

"Tissue web" or "tissue sheet" refers herein to a cellulosic web suitable for making or use as a facial tissue, bath tissue, paper towels, napkins, or the like. It can be layered or unlayered, creped and can consist of a single ply or multiple plies. The tissue webs referred to above are preferably made from natural cellulosic fiber sources such as hardwoods, softwoods, and non-woody species, but can also contain significant amounts of recycled fibers, sized or chemically-modified fibers, or synthetic fibers.

"Basis weight" and "BW" refers herein to the bone dry basis weight of a sample of tissue web or product that is determined by placing the sample in a commercial oven (e.g. Blue M Industrial Ovens serial #10089811 from Thermal Product Solutions or equivalent) and maintained at 105 plus or minus 2 degrees centigrade for 60 plus or minus 5 minutes before weighing. The resulting bone dry basis weight is expressed in grams per square meter (gsm).

"Caliper" refers herein to the thickness of a single sheet measured in accordance with TAPPI test methods T402 "Standard Conditioning and Testing Atmosphere for Paper, Board, Pulp Handsheets and Related Products" and T411 om-89 "Thickness (caliper) of Paper, Paperboard, and Combined Board". Caliper may be expressed in mils (0.001 inches) or microns.

"Sheet bulk" refers herein to the quotient of the caliper (converted to centimeters) divided by the bone dry basis weight (converted to grams per square centimeter). The resulting sheet bulk is expressed in cubic centimeters per gram (cc/g).

"Geometric mean tensile strength" and "GMT" refer herein to the square root of the product of the machine direction tensile strength and the cross-machine direction tensile strength of the web. As used herein, tensile strength refers to mean tensile strength as would be apparent to one skilled on the art.

"Slope" refers herein to the slope of the line resulting from plotting tensile strength (in grams) versus strain (without converting to %) and is an output of the MTS TestWorks™ in the course of determining the tensile strength as described above. Slope is expressed in kilograms (kg) and is measured as the gradient of the least-squares line fitted to the load-corrected strain points falling between a specimen-generated force of 70 to 157 grams (0.687 to 1.540 N) per 3 inches of specimen width.

"Geometric mean slope" (GM Slope) refers herein to the square root of the product of the machine direction slope and the cross-machine direction slope of the web, which are determined as described above.

"Stiffness Index" refers herein to the quotient of the geometric mean slope divided by the geometric mean tensile strength multiplied by 1,000.

$$\text{Stiffness Index} = \frac{\sqrt{MD\ \text{Tensile Slope} \times CD\ \text{Tensile Slope}}}{GMT} \times 1{,}000$$

"Roll bulk" refers herein to the volume of paper divided by its mass on the wound roll. Roll bulk is calculated by multiplying pi (3.142) by the quantity obtained by calculating the difference of the roll diameter squared ($cm^2$) and the outer core diameter squared ($cm^2$) divided by 4, divided by the quantity sheet length (cm) multiplied by the sheet count multiplied by the bone dry basis weight of the sheet (grams per square centimeter).

Test Methods

Tensile Testing

Samples for tensile strength testing are prepared by cutting a 3 inches (76.2 mm)×5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10 or equivalent). The instrument used for measuring tensile strengths is a Constant-Rate-of-Extension (CRE) tensile tester (e.g. MTS Sintech 500/S or equivalent). The data acquisition software is MTS TestWorks® 4 for Windows Ver. 4.08B from MTS Systems Corporation, Eden Prairie, Minn. 55344-2290. The load cell is 50 Newtons from MTS Systems Corporation such that the majority of peak load values fall between 10-90% of the load cell's full scale value. The gauge length between jaws is 2 plus or minus 0.04 inches (50.8 plus or minus 1 mm). The jaws are operated using pneumatic-action and are rubber coated. The minimum grip face width is 3 inches (76.2 mm), and the approximate height of a jaw is 0.5 inches (12.7 mm). The crosshead speed is 10 plus or minus 0.4 inches/min (254 plus or minus 1 mm/min), and the break sensitivity is set at 65 percent. The preload is less than 15 grams with 25 grams as the maximum allowable preload. The sample is placed in the jaws of the instrument, centered both vertically and horizontally. The test is then started and ends when the specimen breaks. The peak load is recorded as either the "MD tensile strength" or the "CD tensile strength" of the specimen depending on direction of the sample being tested. At least ten (10) representative specimens are tested for each tissue sheet and the arithmetic average of all individual specimen tests is either the MD or CD tensile strength for the tissue.

"Geometric Mean" (GM) values for any measurements having a machine direction value and a cross-machine direction value (such as tensile strength, strain and slope) are calculated as the square root of the product obtained by multiplying the machine direction value and the cross-machine direction value.

Kershaw Roll Firmness

Kershaw roll firmness was measured using the Kershaw Test as described in detail in U.S. Pat. No. 6,077,590, which is incorporated herein by reference in a manner consistent with the present disclosure. The apparatus is available from Kershaw Instrumentation, Inc. (Swedesboro, N.J.) and is known as a Model RDT-2002 Roll Density Tester.

KES Surface Test

The surface properties of samples were measured using a KES Surface Tester (Model KES-SE, Kato Techo Co., Ltd., 26 Karato-cho, Nisikujo, Minami-ku, Kyoto, Japan). Samples were tested along the MD and CD and on both sides for 5 repeats with a sample size of 10 cm×10 cm. Care was taken to avoid folding, wrinkling, stressing, or otherwise handling the samples in a way that would deform the sample. Samples were tested using a U-shaped single stainless steel wire probe that was 0.5 mm in diameter and 5 mm at the base, and having a contact force of 10 grams. The test speed was set at 1 mm/s. "SENS" which is the sensitivity setting, was set at "H". "FRIC" was set at "GU" for simultaneous friction and roughness measurement. The data was acquired using KES-FB System Measurement Program KES-FB System Ver 7.09 E for Win98/2000/XP by Kato tech Co., Ltd. The selections in the program were "Testers"=FB4, "Measure"="Optional Condition, "Static Load" for "Friction"=10 g, for "Roughness"=10 g, "Friction Sens"=2×5 and "Roughness Sens"=2×5. All MD and CD properties of each sample were converted to its geometric mean (SQRT (MD*CD)) for a given side of the tissue and the average result between both sides of the tissue was reported as the final result.

The KES Surface Tester determined the mean value of the coefficient of friction (MIU), mean deviation of MIU (MMD), each expressed as dimensionless, and surface roughness (SMD), expressed in microns.

The values of surface smoothness (MIU), mean deviation of MIU (MMD) and surface roughness (SMD) are defined by:

$$MIU(\bar{\mu}) = 1/X\int_0^x \mu dx$$

$$MMD = 1/X\int_0^x |\mu - \bar{\mu}| dx$$

$$SMD = 1/X\int_0^x |T - \bar{T}| dx$$

where $\mu$=friction force divided by compression force $\bar{\mu}$=mean value of $\mu$ x=displacement of the probe on the surface of specimen, cm X=maximum travel used in the calculation, 2 cm T=thickness of specimen at position x, micron
$\bar{T}$=mean value of T, micron

DETAILED DESCRIPTION

The present disclosure relates to spirally-wound, single or multi-ply creped tissue webs. The spirally-wound tissue products comprise tissue webs prepared according to the present disclosure. Generally, the tissue webs and tissue products of the present disclosure have unique combinations of properties that represent various improvements over prior art products. That is, the tissue products prepared according to the present disclosure have improved smoothness and bulk while still maintaining strength, roll bulk and firmness when converted into rolled tissue products.

In certain embodiments the rolled tissue products prepared according to the present disclosure have improved surface properties including, for example, single wire probe mean deviation of MIU (MMD) and mean deviation of surface thickness (SMD). The single wire probe mean deviation of MIU (MMD) is an indication of the variation of the tissue sheet surface coefficient of friction (MIU) and is an indicator of the tissue sheet surface softness. Lower values of MIU indicate less drag on the sample surface; higher MIU values indicate more drag on the sample surface. Lower values of MMD indicate less variation or more uniformity of the sample surface; wherein, higher MMD values indicate more variation of the sample surface. The single wire probe mean deviation of surface thickness (SMD) is an indication of the variation of the tissue sheet surface thickness, that is, depth. Lower SMD values indicate less variation of the tissue sheet surface depth and hence a smoother or less rough tissue sheet surface. Conversely, higher SMD values indicate more variation of the tissue sheet surface depth and hence a rougher tissue sheet surface.

Single wire probe mean deviation of MIU (MMD) and mean deviation of surface thickness (SMD) are of particular significance to the consumer because lower values of these properties are indicative of tissue products, such as those prepared according to the present disclosure, that are softer and smoother than prior art tissue products. Accordingly, embodiments of the creped tissue webs of the present disclosure have MMD values of less than about 0.040 and preferably from about 0.020 to about 0.040. In single ply embodiments of the present disclosure, the MMD value is less than about 0.040 and preferably from about 0.030 to about 0.050. In multi-ply embodiments of the present disclosure, the MMD value is less than about 0.035 and preferably from about 0.020 to about 0.035.

In certain embodiments of the creped tissue webs of the present disclosure, the tissue sheets have SMD values of less than about 3.5 microns and preferably from about 1.5 to about 3.5 microns. In single ply embodiments of the present disclosure, the SMD value is less than about 3.0 microns and preferably from about 2.7 to about 3.0 microns. In multi-ply embodiments of the present disclosure, the SMD value is less than about 3.5 microns and preferably from about 1.5 to about 3.5 microns.

In certain embodiments of the creped tissue webs of the present disclosure, the tissue sheets have MIU values of less than about 0.800 and preferably from about 0.400 to about 0.800 microns. In single ply embodiments of the present disclosure, the MIU value is less than about 0.700 and preferably from about 0.550 to about 0.700. In multi-ply embodiments of the present disclosure, the MIU value is less than about 0.800 and preferably from about 0.600 to about 0.800.

Another factor affecting perceived softness is low lint levels. It is difficult to obtain lint levels that are acceptable to the consumer while generating a soft tissue surface. In embodiments of the present disclosure, process conditions were adjusted until a low lint level tissue sheet was obtained as determined by visual inspection.

In embodiments of the present disclosure, the sheet bulk of the creped tissue sheets can be greater than about 10 cubic centimeters per gram (cc/g). More specifically for embodiments of single ply tissue sheets, the sheet bulk can be from about 12 to about 15 cc/g. Furthermore, for embodiments of multi-ply tissue sheets, the sheet bulk can be from about 10 to about 12 cc/g.

The geometric mean tensile (GMT) strength will vary depending upon the fiber furnish used to produce the tissue sheet, the manner in which the tissue web is produced and the basis weight of the tissue web. The GMT of creped tissue sheets formed according to the present disclosure may be greater than about 650 grams per 3 inches (g/3 inches). For example, embodiments of single ply tissue sheets of the present disclosure may have a GMT greater than about 650 g/3 inches, and more particularly from about 650 to about 1000 g/3 inches. Embodiments of multi-ply tissue sheets of the present disclosure may have a GMT greater than about 700 g/3 inches and more particularly from about 700 to about 1000 g/3 inches.

While the creped tissue webs of the present disclosure generally have lower geometric mean slopes compared to webs of the prior art, the webs maintain a sufficient amount of tensile strength to remain useful to the consumer. For example, in certain instances, the disclosure provides single ply tissue webs having a geometric mean slope less than about 5.0 kg and a GMT less than about 1,000 g/3 inches. The disclosure provides multi-ply tissue webs having a geometric mean slope less than about 8.0 kg and a GMT of less than about 1000 g/3 inches.

Additionally, improved Stiffness Index is of particular significance to the consumer because tissue products, such as those prepared according to the present disclosure, should have a moderate degree of flexibility while in use. The amount of flexibility of the tissue sheet contributes to the consumer's perception of softness. If a tissue product has a high Stiffness Index value, the tissue sheet may not easily conform to the user's hand, face or body; while a low Stiffness Index value indicates a more flexible tissue sheet. Single ply tissue sheet embodiments of the present disclosure preferably have a Stiffness Index less than about 8.0, still more preferably such as from about 6.0 to about 8.0. Accordingly, multi-ply embodiments of the present disclosure preferably have a Stiffness Index less than about 10.0 and more preferably such as from about 7.5 to about 10.0. As such the tissue webs of the present disclosure are not only soft, but are also strong enough to withstand use.

Rolled tissue products made according to the present disclosure can exhibit the above creped tissue sheet properties at various basis weights. For example, single ply tissue sheet embodiments of the present disclosure can have a bone dry basis weight less than about 40 grams per square meter (gsm), for example from about 30 to about 40 gsm and more specifically from about 35 to about 38 gsm. Multi-ply tissue sheet embodiments of the present disclosure can have a bone dry basis weight less than about 40 gsm, for example from about 35 to about 40 gsm and more specifically from about 36 to about 39 gsm. The basis weight of the single and multi-ply creped tissue sheets of the present disclosure is of significance because the spirally wound tissue products have a unique combination of properties that represent various improvements over prior art products. For instance, rolled tissue products prepared according to the present disclosure may have improved softness and bulk while still maintaining strength with the use of less material than prior art tissue webs.

In certain embodiments, rolled products made according to the present disclosure may comprise a spirally wound single ply tissue web having a Kershaw roll firmness of less than about 7.0 mm and preferably from about 5.0 to about 7.0 mm. In other embodiments rolled products made according to the present disclosure may comprise a spirally wound, multi-ply tissue web having a Kershaw roll firmness of less than about 10.0 mm and preferably from about 7.5 to about 10.0 mm. Within the above-roll firmness ranges, rolls made according to the present disclosure do not appear to be overly soft and "mushy" as may be undesirable by some consumers during some applications.

It has now been discovered that rolled tissue products made according to the present disclosure can be produced such that the creped tissue webs can maintain a roll bulk of at least 8 cubic centimeters per gram (cc/g) even when spirally wound under tension. For example, embodiments of single ply creped tissue sheets of the present disclosure spirally wound into a roll may have a roll bulk of greater than about 10 cc/g, and more particularly from about 10 to about 12 cc/g. Embodiments of multi-ply creped tissue sheets of the present disclosure spirally wound into a roll may have a roll bulk of greater than about 8 cc/g, and more particularly from about 8 to about 12 cc/g.

In an embodiment, a single ply creped tissue sheet is spirally wound into a roll wherein the tissue sheet has a single wire probe mean deviation of MIU (MMD) of less than about 0.040 and a sheet bulk of greater than about 12 cc/g. The tissue sheet may also have a GMT of greater than about 650 g/3 inches, a Stiffness Index of less than about 8.0, and may have an SMD of less than about 3.0 microns. The bone dry basis weight of the tissue sheet may be less than about 40 gsm. The rolled tissue product may have a Kershaw roll firmness of less than about 7.0 mm and may also have a roll bulk of greater than about 10 cc/g.

In another embodiment, a multi-ply creped tissue sheet is spirally wound into a roll wherein the tissue sheet has a single wire probe mean deviation of MIU (MMD) of less than about 0.035 and a sheet bulk of greater than about 10 cc/g. The tissue sheet may also have a GMT of greater than about 700 g/3 inches, a Stiffness Index of less than about 10.0, and may have an SMD of less than about 3.5 microns. The bone dry basis weight of the tissue sheet may be less than about 40 gsm. The rolled tissue product may have a Kershaw roll firmness of less than about 5.0 mm and may also have a roll bulk of greater than about 8 cc/g.

In yet a further embodiment, a two ply tissue sheet is spirally wound into a roll, wherein each ply of the two ply tissue sheet is creped. The two ply tissue sheet has an MMD of less than about 0.035 and an SMD of less than about 3.5 microns; wherein the rolled tissue product has a Kershaw roll firmness of less than about 5.0 mm and also has a roll bulk of greater than about 8 cc/g. The tissue sheet may also have a sheet bulk of greater than about 10 cc/g, may also have a GMT of greater than about 700 g/3 inches, and may have a Stiffness Index of less than about 10.0. The bone dry basis weight of the tissue sheet may be less than about 40 gsm.

Tissue webs useful in preparing spirally wound tissue products according to the present disclosure can vary depending upon the particular application. In general, the webs can be made from any suitable type of fiber. For instance, the base sheet can be made from pulp fibers, other natural fibers, synthetic fibers, and the like. Suitable cellulosic fibers for use in connection with this disclosure include secondary (recycled) papermaking fibers and virgin papermaking fibers in all proportions. Such fibers include, without limitation, hardwood and softwood fibers as well as non-woody fibers. Noncellulosic synthetic fibers can also be included as a portion of the furnish. It has been found that a high quality product having a unique balance of properties may be made using predominantly secondary fibers or all secondary fibers.

Tissue webs made in accordance with the present disclosure can be made with a homogeneous fiber furnish or can be formed from a stratified fiber furnish producing layers within the single or multi-ply product. Stratified tissue webs can be formed using equipment known in the art, such as a multi-layered headbox. Both strength and softness of the base web can be adjusted as desired through layered tissues, such as those produced from stratified headboxes.

For instance, different fiber furnishes can be used in each layer in order to create a layer with the desired characteristics. For example, layers containing softwood fibers have higher tensile strengths than layers containing hardwood fibers. Hardwood fibers, on the other hand, can increase the softness of the web.

When constructing a web from a stratified fiber furnish, the relative weight of each layer can vary depending upon the particular application. For example, in one embodiment, when constructing a web containing three layers, each layer can be from about 15 to about 40 percent of the total weight of the web, such as from about 25 to about 35 percent of the weight of the web.

Wet strength resins may be added to the furnish as desired to increase the wet strength of the final product. Presently, the most commonly used wet strength resins belong to the class of polymers termed polyamide-polyamine epichlorohydrin resins. There are many commercial suppliers of these types of resins including Hercules, Inc. (Kymene™), Henkel Corp. (Fibrabond™), Borden Chemical (Cascamide™), Georgia-Pacific Corp. and others. These polymers are characterized by having a polyamide backbone containing reactive crosslinking groups distributed along the backbone. Other useful wet strength agents are marketed by American Cyanamid under the Perez™ trade name.

Similarly, dry strength resins can be added to the furnish as desired to increase the dry strength of the final product. Such dry strength resins include, but are not limited to carboxymethyl celluloses (CMC), any type of starch, starch derivatives, gums, polyacrylamide resins, and others as are well known. Commercial suppliers of such resins are the same as those that supply the wet strength resins discussed above.

Another strength chemical that can be added to the furnish is Baystrength 3000 available from Kemira (Atlanta, Ga.), which is a glyoxalated cationic polyacrylamide used for imparting dry and temporary wet tensile strength to tissue webs. In particular embodiments, when constructing a web containing two or more layers, only the layer contacting the Yankee dryer may have a strength chemical or resin added to the furnish of that layer. The selective incorporation of strength additives, such as Baystrength 3000, into the Yankee contacting layer is particularly beneficial when employing registered creping techniques described herein.

Tissue products of the present disclosure can generally be formed by any of a variety of creped papermaking processes known in the art. Preferably the tissue web is formed by creped through-air drying and more preferably through registered creped through-air drying. When forming multi-ply tissue products, the separate plies can be made from the same process or from different processes as desired.

For example, in one embodiment, tissue webs may be creped, through-air dried webs formed using processes known in the art. To form such webs, an endless traveling forming fabric, suitably supported and driven by guide rolls, receives the layered papermaking stock issuing from the headbox. A vacuum box is disposed beneath the forming fabric and is adapted to remove water from the fiber furnish to assist in forming a web. From the forming fabric, a formed web is transferred to a second fabric. The fabric is supported for movement around a continuous path by a plurality of guide rolls. A pick-up roll designed to facilitate transfer of web from fabric to fabric may be included to transfer the web.

Preferably the formed web is dried by transfer to the surface of a rotatable heated dryer drum, such as a Yankee dryer. The web may be transferred to an impression fabric which is then used to transfer the web to the Yankee dryer, or preferably, transferred to the Yankee dryer directly from the throughdrying fabric. In an embodiment, the through-drying fabric is used to transfer the web to the surface of the Yankee dryer such that registration of the web with the throughdrying fabric pattern is maintained, and hence, high caliper and bulk of the web are maintained. In accordance with the present disclosure, the creping composition of the present disclosure may be applied topically to the tissue web while the web is traveling on the fabric or may be applied to the surface of the Yankee dryer for transfer onto one side of the tissue web. In this manner, the creping composition is used to adhere the tissue web to the Yankee dryer. In this embodiment, as the web is carried through a portion of the rotational path of the Yankee dryer surface, heat is imparted to the web causing most of the moisture contained within the web to be evaporated. The web is then removed from the Yankee dryer by a creping blade. Creping the web as it is formed further reduces internal bonding within the web and increases softness. Applying the creping composition to the web during creping, on the other hand, may increase the strength of the web.

In another embodiment, the formed web is transferred to the surface of the rotatable heated dryer drum, which may be a Yankee dryer by a press roll. The press roll may, in one embodiment, comprise a suction pressure roll. In order to adhere the web to the surface of the dryer drum, a creping adhesive may be applied to the surface of the dryer drum by a spraying device. The spraying device may emit a creping composition as previously described in the present disclosure. The web is adhered to the surface of the dryer drum and then creped from the drum using the creping blade. If desired, the dryer drum may be associated with a hood. The hood may be used to force air against or through the web.

In other embodiments, once creped from the dryer drum, the web may be adhered to a second dryer drum. The second dryer drum may comprise, for instance, a heated drum surrounded by a hood. The drum may be heated from about 25 to about 200° C., such as from about 100 to about 150° C.

In order to adhere the web to the second dryer drum, a second spray device may emit an adhesive onto the surface of the dryer drum. For example, the second spray device may emit a creping composition as described above. The creping composition not only assists in adhering the tissue web to the dryer drum, but also is transferred to the surface of the web as the web is creped from the dryer drum by the creping blade.

Once creped from the second dryer drum, the web may, optionally, be fed around a cooling reel drum and cooled prior to being wound on a reel.

In addition to applying the creping composition during formation of the fibrous web, the creping composition may also be used in post-forming processes. For example, in one aspect, the creping composition may be used during a print-creping process. Specifically, once topically applied to a fibrous web, the creping composition has been found well-suited to adhering the fibrous web to a creping surface, such as in a print-creping operation.

For example, once a fibrous web is formed and dried, in one aspect, the creping composition may be applied to at least one side of the web and the at least one side of the web may then be creped. In general, the creping composition may be applied to only one side of the web and only one side of the web may be creped, the creping composition may be applied to both sides of the web and only one side of the web is creped, or the creping composition may be applied to each side of the web and each side of the web may be creped.

Once creped, the tissue web may be pulled through a drying station. The drying station can include any form of a heating unit, such as an oven energized by infra-red heat, microwave energy, hot air or the like. A drying station may be necessary in some applications to dry the web and/or cure the creping composition, depending upon the creping composition selected. However, in other applications a drying station may not be needed.

FIG. 1 illustrates a process for preparing tissue webs according to the present disclosure. A papermaking headbox 2 injects or deposits a furnish of an aqueous suspension of papermaking fibers onto a forming fabric 4 thereby forming a wet tissue web 6. The forming process of the present disclosure may be any conventional forming process known in the papermaking industry. Such formation processes include, but are not limited to, Fourdriniers, roof formers such as suction breast roll formers, and gap formers such as twin wire formers and crescent formers.

The wet tissue web 6 forms on the forming fabric 4 as the forming fabric 4 revolves about guide rolls. The forming fabric 4 serves to support and carry the newly-formed wet tissue web 6 downstream in the process as the wet tissue web 6 is partially dewatered to a consistency of about 10 percent based on the dry weight of the fibers. Additional dewatering of the wet tissue web 6 may be carried out by known paper making techniques, such as vacuum suction boxes, while the forming fabric 4 supports the wet tissue web 6. The wet tissue web 6 may be additionally dewatered to a consistency of at least about 20 percent, more specifically between about 20 to about 40 percent, and more specifically about 20 to about 30 percent.

The forming fabric 4 can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.). Forming fabrics comprising non-woven base layers may also be useful, including those of Scapa Corporation made with extruded polyurethane foam such as the Spectra Series.

The wet tissue web 6 is then transferred from the forming fabric 4 to a transfer fabric 8 while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric 8 may be carried out with the assistance of positive and/or negative pressure. For example, in one embodiment, a vacuum shoe 10 can apply negative pressure such that the forming fabric 4 and the transfer fabric 8 simultaneously converge and diverge at the leading edge of the vacuum slot. Typically, the vacuum shoe 10 supplies pressure at levels between about 10 to about 25 inches of mercury. As stated above, the vacuum transfer shoe 10 (negative pressure) can be supplemented or replaced by the use of positive pressure from the opposite side of the web to blow the web onto the next fabric. In some embodiments, other vacuum shoes can also be used to assist in drawing the fibrous web 6 onto the surface of the transfer fabric 8.

Typically, the transfer fabric 8 travels at a slower speed than the forming fabric 4 to enhance the MD and CD stretch of the web, which generally refers to the stretch of a web in its cross (CD) or machine direction (MD) (expressed as percent elongation at sample failure). For example, the relative speed difference between the two fabrics can be from about 1 to about 30 percent, in some embodiments from about 5 to about 20 percent, and in some embodiments, from about 10 to about 15 percent. This is commonly referred to as "rush transfer". During "rush transfer", many of the bonds of the web are believed to be broken, thereby forcing the sheet to bend and fold into the depressions on the surface of the transfer fabric 8. Such molding to the contours of the surface of the transfer fabric 8 may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure.

The wet tissue web 6 is then transferred from the transfer fabric 8 to a throughdrying fabric 12. Typically, the transfer fabric 8 travels at approximately the same speed as the throughdrying fabric 12. However, it has now been discovered that a second rush transfer may be performed as the web is transferred from the transfer fabric 8 to a throughdrying fabric 12. This rush transfer is referred to herein as occurring at the second position and is achieved by operating the throughdrying fabric 12 at a slower speed than the transfer fabric 8. By performing rush transfer at two distinct locations, i.e., the first and the second positions, a tissue product having increased CD stretch may be produced.

In addition to rush transferring the wet tissue web 6 from the transfer fabric 8 to the throughdrying fabric 12, the wet tissue web 6 may be macroscopically rearranged to conform to the surface of the throughdrying fabric 12 with the aid of a vacuum transfer roll or a vacuum transfer shoe like vacuum shoe 10. If desired, the throughdrying fabric 12 can be run at a speed slower than the speed of the transfer fabric 8 to further enhance MD stretch of the resulting absorbent tissue product. The transfer may be carried out with vacuum assistance to ensure conformation of the wet tissue web 6 to the topography of the throughdrying fabric 12.

While supported by the throughdrying fabric 12, the wet tissue web 6 is dried to a final consistency of about 94 percent or greater by a throughdryer 14. After the web is through-air dried, the web is creped. In order to adhere the web 6 to the Yankee dryer 20, a creping adhesive applicator 18 applies a creping adhesive to the Yankee dryer 20. The dried tissue web 16 is held in registration with the pattern of the throughdrying fabric 12 as the dried tissue web 16 is transferred to the Yankee dryer 20. The dried tissue web 16 is then creped from the Yankee dryer 20 with a creping blade 22. The dried tissue web 16 then passes through a winding nip and is wound into a roll of tissue 24 onto reel 26 for subsequent converting, such as slitting cutting, folding, and packaging.

The web is transferred to the throughdrying fabric for final drying preferably with the assistance of vacuum to ensure macroscopic rearrangement of the web to give the desired bulk and appearance. The use of separate transfer and throughdrying fabrics can offer various advantages since it allows the two fabrics to be designed specifically to address key product requirements independently. For example, the transfer fabrics are generally optimized to allow efficient conversion of high rush transfer levels to high MD stretch while throughdrying fabrics are designed to deliver bulk and CD stretch. It is therefore useful to employ a transfer fabric having moderate degrees of coarseness and surface topography and throughdrying fabrics having high degrees of coarseness and surface topography. The result is that a relatively smooth sheet leaves the transfer section and then is macroscopically rearranged (with vacuum assist) by the high topography throughdrying fabric to yield a high bulk, high CD stretch web.

Because of its commercial availability and practicality, throughdrying is well known and is one commonly used means for noncompressively drying the web for purposes of this invention. Suitable throughdrying fabrics include, without limitation, fabrics with substantially continuous machine direction ridges whereby the ridges are made up of multiple warp strands grouped together, such as those disclosed in U.S. Pat. No. 6,998,024. Other suitable throughdrying fabrics include those disclosed in U.S. Pat. No. 7,611,607, which is incorporated herein in a manner consistent with the present disclosure, particularly the fabrics denoted as Fred (t1207-77), Jetson (t1207-6) and Jack (t1207-12). In certain embodiments, the t-807-1 transfer fabric available from Voith Fabrics (Appleton, Wis.) can be used as a throughdrying fabric.

While coarse, high-topography throughdrying fabrics can increase CD stretch and bulk, they may also result in low web adhesion when the web is transferred to the Yankee dryer. Accordingly, in certain embodiments, it may be necessary to modify traditional creping compositions to accommodate the decreased adhesion. Particularly useful creping compositions, for example, may omit common release agents, such as mineral oils, vegetable oils, non-oil polymers and surfactants, such as those sold under the tradename Rezosol™ (Ashland, Inc., Covington, Ky.). The omission of a release agent from the creping composition has been found to result in high web adhesion, and hence, the web may be aggressively creped and "peeled" from the Yankee dryer with high web tension. The web tension may be roughly twice that is normally used for creped throughdried tissue produced on the same tissue machine. For example, in certain embodiments, web tensions may range from approximately 0.05 to 0.17 pounds per lineal inch (pli). In addition to modifying the creping composition, for example, in certain embodiments, an inverted creping blade may be used; that is, the blade may be turned 180 degrees from the normal configuration.

In the wound product, it is often advantageous to wind the product with the softest side facing the consumer, and hence the shearing process to increase the softness of this side is preferred. However, it is also possible to treat the air side of the web rather than the fabric side, and in these embodiments, it would be possible to increase the air side softness to a level higher than that of the fabric side. In other embodiments, the web can be wound such that the crepe ratio, that is, the speed of the Yankee dryer divided by the speed of the reel drum can range from about 1.0 to about 1.2. Additionally, high web tension can be maintained between the Yankee and the reel to prevent sheet wrinkling.

The target or desired basis weight of the tissue sheet may also affect the necessary processing conditions. In particular embodiments, as the basis weight increased, higher levels of rush transfer and lower crepe ratios were incorporated to produce tissue sheets and rolls of the present disclosure. In yet other embodiments, as the basis weight decreased, lower levels of rush transfer and higher crepe ratios were utilized to produce tissue sheets and rolls of the present disclosure.

The process of the present disclosure is well suited to forming multi-ply tissue products. The multi-ply tissue products can contain two plies, three plies, or a greater number of plies. In one particular embodiment, a two ply rolled tissue product is formed according to the present disclosure in which both plies are manufactured using the same papermaking process, such as, for example, creped through-air dried. However, in other embodiments, the plies may be formed by two different processes. Generally, prior to being wound in a roll, the first ply and the second ply are attached together. Any suitable manner for laminating the webs together may be used. For example, the process may include a crimping device that causes the plies to mechanically attach together through fiber entanglement. In an alternative embodiment, however, an adhesive may be used in order to attach the plies together.

The following examples are intended to illustrate particular embodiments of the present disclosure without limiting the scope of the appended claims.

EXAMPLES

Base sheets were produced using a through-air dried tissue making process and creped after final drying (hereinafter referred to as "CTAD"). Base sheets with various bone dry basis weights in grams per square meter (gsm) were produced. Some of the base sheets were then converted into two ply tissue webs and spirally wound into rolled tissue products; the remaining base sheets were treated as single ply tissue webs and spirally wound into rolled tissue products.

In all cases, the base webs were produced from a furnish comprising a blend of 50 percent northern softwood kraft and 50 percent eucalyptus. However, the product was produced using a layered headbox fed by three stock chests such that the product was made in three layers, each a 50/50 blend of softwood and eucalyptus fibers. Strength was controlled via the addition of Baystrength 3000 and/or by refining the furnish. When refining, only the center layer of the three-layer web was refined. Baystrength 3000 is a cationic glyoxalated polyacrylamide resin supplied by Kemira (Atlanta, Ga.) providing dry and temporary wet tensile strength.

Additionally, the webs were formed on a TissueForm V forming fabric. Tissue webs for samples 1-3 were rush transferred to a Voith 2164 transfer fabric and for samples 4-6, were rush transferred to a Jetson (t1207-6) transfer fabric. The tissue webs for all samples were vacuum dewatered to roughly 25 percent consistency. The tissue webs for samples 1-3 were then transferred to a t-807-1 throughdrying fabric; the tissue webs for samples 4-6 were then transferred to a Jack (t1207-12) throughdrying fabric. Rush transfer was not utilized at the transfer to the t-807-1 or to the Jack (t1207-12) throughdrying fabrics. After the web was transferred to the t-807-1 or the Jack (t1207-12) throughdrying fabrics, the web was dried to greater than 90% consistency and then transferred to a Yankee dryer while maintained in registration with the throughdrying fabric. The web was then creped from the Yankee dryer.

An adhesive formulation of polyvinyl alcohol and Kymene™ was used for creping for all of the samples. The ratio of polyvinyl alcohol solids to Kymene™ solids was 24:1 for the single ply samples and 12:1 for the multi-ply samples. The adhesive composition and add on rates were typical for standard creped throughdried tissue. The sheet was dried to a very high level (less than about 2 percent moisture) on the Yankee dryer to maximize bulk in the creping process. Yankee steam pressure was held at an average of approximately 25 to 35 psi for all samples. High web tension between the Yankee and the reel was maintained to prevent sheet wrinkling. Web tensions ranged from approximately 0.05 to 0.17 pounds per lineal inch (pli). Line speed of the Yankee to the reel speed, that is the crepe ratio, ranged from approximately from about 1.0 to about 1.2. The webs were creped using an inverted creping blade turned 180 degrees from the typical creping geometry.

The post-tissue machine webs were then converted into various bath tissue rolls. Samples 1, 3, 5 and 6 were converted as single ply bath tissue rolls; samples 2 and 4 were converted as two ply bath tissue rolls. In the converting process for the two ply tissue webs, the webs were crimped for ply attachment and care was taken not to create any web compression that might reduce web caliper.

Table 1 shows the process conditions for each of the samples prepared in accordance with the present disclosure. The amount of Baystrength 3000 strength additive added to the respective samples is expressed in kilograms per metric ton (kg/MT) based on the total furnish. In instances where Baystrength was added, the Baystrength was added to either the first, second or third layer, as specified below. For example, for code 1 the total addition was 3.5 kg/MT, and all of the chemical was added to the center layer, thus making the addition based on that layer 3.5 kg/MT. No Baystrength was added to the outer layers for this code, making the addition based on the three layers 0, 3.5 and 0 kg/MT respectively.

TABLE 1

| Sample No. | Basis Weight (gsm) | Center Layer Refining Time (min) | Baystrength 3000 (kg/MT) | Baystrength Layer |
|---|---|---|---|---|
| 1 | 31.60 | 2 | 3.5 | 0/3.5/0 |
| 2 | 19.65 | 0 | 2.0 to outer layers and 4.0 to inner layer | 2/4/2 |
| 3 | 40.10 | 0 | 2.0 | 2/2/2 |
| 4 | 19.05 | 2 | 2.0 to inner and one outer layer and 4.0 to outer layer contacting Yankee surface | 2/2/4 |
| 5 | 30.30 | 2 | 2.0 | 2/0/2 |
| 6 | 38.60 | 0 | 2.0 | 2/2/2 |

Table 2, below, shows additional process parameters for the samples.

TABLE 2

| Sample No. | Transfer Fabric | TAD Fabric | Rush Transfer (%) | Crepe Ratio | Web Tension (pli) | Yankee Steam Pressure (psi) |
|---|---|---|---|---|---|---|
| 1 | 2164 | 807 | 18 | 1.02 | 0.16 | 24 |
| 2 | 2164 | 807 | 7.5 | 1.12 | 0.05 | 25 |
| 3 | 2164 | 807 | 24 | 1.01 | 0.16 | 35 |
| 4 | Jetson | Jack | 7.5 | 1.12 | 0.05 | 25 |
| 5 | Jetson | Jack | 18 | 1.04 | 0.17 | 24 |
| 6 | Jetson | Jack | 24 | 1.02 | 0.14 | 35 |

Table 3, below, summarizes physical properties, of the converted tissue webs prepared as described above. Note that rolled product samples 2 and 4 comprised two plies of base sheet such that rolled product sample 2 comprised two plies of base sheet sample 2, as specified above, and rolled sample 4 comprised two plies of base sheet sample 4. The remaining rolled product samples comprised a single ply of base sheet, which are rolled samples 1, 3, 5 and 6.

TABLE 3

| Sample No. | Number of Plies | Basis Weight (gsm) | MD Tensile (gf) | MDS (%) | MD Slope (kg) | CD Tensile (gf) | CDS (%) | CD Slope (kg) | GMT (g/3") | GMS (%) | GM Slope (kg) | Stiffness Index | Caliper (mm) |
|---|---|---|---|---|---|---|---|---|---|---|---|---|---|
| Roll 1 | 1 | 32.2 | 1282 | 15.5 | 6 | 663 | 6.5 | 12 | 922 | 10.0 | 9.0 | 9.7 | 0.32 |
| Roll 2 | 2 | 39.3 | 1169 | 12.3 | 7 | 489 | 8.8 | 8 | 756 | 10.4 | 7.1 | 9.4 | 0.39 |
| Roll 3 | 1 | 40.1 | 1411 | 20.5 | 5 | 718 | 7.3 | 13 | 1006 | 12.2 | 8.1 | 8.0 | 0.38 |
| Roll 4 | 2 | 38.1 | 1086 | 13.2 | 6 | 467 | 9.3 | 5 | 712 | 11.1 | 5.5 | 7.7 | 0.45 |
| Roll 5 | 1 | 30.3 | 506 | 20.5 | 3 | 940 | 9.6 | 5 | 689 | 14.1 | 4.1 | 6.0 | 0.45 |
| Roll 6 | 1 | 38.6 | 490 | 20.3 | 3 | 917 | 10.2 | 5 | 671 | 14.4 | 4.1 | 6.1 | 0.51 |

The comparable product parameters for current commercial TAD bath tissues are shown in table 4. As indicated in the table, these commercial products exhibit a wide range of properties, including wide ranges of basis weight, strength and flexibility properties. Table 4 shows the TAD products offered for sale by Proctor & Gamble under the trade name Charmin®; included are 4 variants.

TABLE 4

| Commercial Product | Number of Plies | Basis Weight (gsm) | MD Tensile (gf) | MDS (%) | MD Slope (kg) | CD Tensile (gf) | CDS (%) | CD Slope (kg) | GMT (g/3") | GMS (%) | GM Slope (kg) | Stiffness Index | Caliper (mm) |
|---|---|---|---|---|---|---|---|---|---|---|---|---|---|
| Charmin ® Basic | 1 | 29.9 | 1266 | 20.5 | 8.1 | 659 | 7.7 | 9.2 | 913 | 12.5 | 8.6 | 9.45 | 0.35 |
| Charmin ® Ultra Sensitive | 2 | 44.6 | 963 | 18.4 | 7.3 | 575 | 8.7 | 10.4 | 744 | 12.6 | 8.7 | 11.7 | 0.50 |
| Charmin ® Ultra Soft | 2 | 45.6 | 1047 | 23.9 | 6.8 | 538 | 9.4 | 6.5 | 751 | 15.0 | 6.6 | 8.8 | 0.53 |
| Charmin ® Ultra Strong | 2 | 36.1 | 1604 | 15.6 | 13.0 | 817 | 10.4 | 9.0 | 1145 | 12.7 | 10.8 | 9.4 | 0.50 |

The surface properties of tissue webs prepared according to the disclosure as described above were also evaluated using the KES Surface Tester (model KES-SE) as described in the Test Methods Section. The results of the surface analysis, along with bulk and Kershaw roll firmness values, are included in table 5, below.

TABLE 5

| Sample No. | Number of Plies | Basis Weight (gsm) | Roll Bulk (cc/g) | Sheet Bulk (cc/g) | Kershaw roll firmness (mm) | Deviation of Surface Thickness single wire probe SMD (microns) | Mean Deviation of MIU single wire probe, MMD | Mean Value of Coefficient of Friction, MIU |
|---|---|---|---|---|---|---|---|---|
| Roll 1 | 1 | 32.2 | 8.3 | 10.0 | 3.4 | 2.74 | 0.039 | 0.584 |
| Roll 2 | 2 | 39.3 | 8.8 | 10.0 | 3.3 | 1.96 | 0.0246 | 0.621 |

TABLE 5-continued

| Sample No. | Number of Plies | Basis Weight (gsm) | Roll Bulk (cc/g) | Sheet Bulk (cc/g) | Kershaw roll firmness (mm) | Deviation of Surface Thickness single wire probe SMD (microns) | Mean Deviation of MIU single wire probe, MMD | Mean Value of Coefficient of Friction, MIU |
|---|---|---|---|---|---|---|---|---|
| Roll 3 | 1 | 40.1 | 7.6 | 9.4 | 7.6 | 2.96 | 0.0367 | 0.599 |
| Roll 4 | 2 | 38.1 | 10.6 | 11.7 | 5.0 | 2.25 | 0.0256 | 0.768 |
| Roll 5 | 1 | 30.3 | 12.5 | 14.9 | 5.8 | 2.73 | 0.0335 | 0.589 |
| Roll 6 | 1 | 38.6 | 11.2 | 13.1 | 6.2 | 3.06 | 0.0348 | 0.689 |

The surface properties of comparable current commercial TAD bath tissues were also evaluated using the KES Surface Tester (model KES-SE) as described in the Test Methods Section. The results of the surface analysis, along with bulk and Kershaw roll firmness values, are included in table 6, below.

TABLE 6

| Commercial Product | Number of Plies | Basis Weight (gsm) | Roll Bulk (cc/g) | Sheet Bulk (cc/g) | Kershaw roll firmness (mm) | Deviation of Surface Thickness single wire probe SMD (microns) | Mean Deviation of MIU single wire probe, MMD | Mean Value of Coefficient of Friction, MIU single wire probe |
|---|---|---|---|---|---|---|---|---|
| Charmin ® Basic | 1 | 29.9 | 11.0 | 11.6 | 7.9 | 3.57 | 0.0461 | 0.482 |
| Charmin ® Ultra Strong | 2 | 36.1 | 14.1 | 13.9 | 7.6 | 4.46 | 0.0431 | 0.538 |
| Charmin ® Ultra Soft | 2 | 45.6 | 10.9 | 11.6 | 4.9 | 3.86 | 0.0377 | 0.592 |
| Charmin ® Ultra Sensitive | 2 | 44.6 | 9.7 | 11.2 | 4.8 | 3.50 | 0.0403 | 0.468 |

Comparing the single ply samples of the present disclosure to the single ply commercial sample from tables 4 and 6, the commercial Charmin® Basic product has a sheet bulk of 11.6 cc/g, an MMD value of 0.0461 and an SMD value of 3.57 microns, wherein the single ply samples of the present disclosure have sheet bulk values of greater than about 12.0 cc/g, MMD values of less than about 0.0400 and SMD values less than about 3.00 microns. Comparing the two ply samples of the present disclosure to the two ply commercial samples from table 5, the commercial Charmin® Ultra Strong product has the highest sheet bulk of 13.9 cc/g, the lowest MMD value achieved is that of the Charmin® Ultra Soft product at 0.0377 and the lowest SMD value achieved is that of the Charmin® Ultra Sensitive at 3.50 microns, wherein the two ply samples of the present disclosure have sheet bulk values of greater than about 10.0 cc/g, MMD values of less than about 0.0350 and SMD values less than about 3.50 microns.

In the interests of brevity and conciseness, any ranges of values set forth in this disclosure contemplate all values within the range and are to be construed as support for claims reciting any sub-ranges having endpoints which are whole number values within the specified range in question. By way of hypothetical example, a disclosure of a range from 1 to 5 shall be considered to support claims to any of the following ranges: 1 to 5; 1 to 4; 1 to 3; 1 to 2; 2 to 5; 2 to 4; 2 to 3; 3 to 5; 3 to 4; and 4 to 5.

While particular embodiments have been illustrated and described, it would be obvious to those skilled in the art that various other changes and modifications can be made without departing from the spirit and scope of this disclosure. It is therefore intended to cover in the appended claims all such changes and modifications that are within the scope of this disclosure.

We claim:

1. A rolled tissue product comprising a multi-ply web spirally wound into a roll, the multi-ply web comprising a first creped through-air dried web and second creped through-air dried web, the multi-ply web having a sheet bulk greater than about 12.0 cc/g, a Stiffness Index from about 7.5 to about 10.0 and a single wire probe mean deviation of MUI (MMD) from about 0.020 to about 0.035.

2. The rolled tissue product of claim 1, wherein the rolled tissue product has a Kershaw roll firmness from about 5.0 to about 10.0 mm.

3. The rolled tissue product of claim 1, wherein the multi-ply web has a geometric mean tensile (GMT) greater than about 700 g/3".

4. The rolled tissue product of claim 1, wherein the multi-ply web has a GMT from about 700 to about 1,000 g/3.

5. The rolled tissue product of claim 1, wherein the multi-ply web has a basis weight from about 35 to about 40 grams per square meter (gsm).

6. The rolled tissue product of claim 1, wherein the rolled tissue product has a roll bulk from about 10 to about 12 cc/g.

7. The rolled tissue product of claim 1, wherein the multi-ply web has a single wire probe mean deviation of Surface Thickness (SMD) of less than about 3.5 microns.

8. The rolled tissue product of claim 1, wherein the multi-ply web has a MIU value less than about 0.800.

9. The rolled tissue product of claim 1, wherein the multi-ply web has a single wire probe mean deviation of Surface Thickness (SMD) from about 1.5 to about 3.5 microns and a MIU value from about 0.600 to about 0.800.

10. A rolled tissue product comprising a single ply web spirally wound into a roll, the web comprising a creped through-air dried web having a basis weight less than about 40 gsm, a sheet bulk greater than about 12 cc/g, a Stiffness Index less than about 8.0 and a single wire probe mean deviation of MUI (MMD) from about 0.030 to about 0.040.

11. The rolled tissue product of claim 10, wherein the single ply web has a basis weight from about 35 to about 38 gsm.

12. The rolled tissue product of claim 10, wherein the single ply web has a Stiffness Index from about 6.0 to about 8.0.

13. The rolled tissue product of claim 10, wherein the single ply web has a GMT from 650 to about 1,000 g/3".

14. The rolled tissue product of claim 10, wherein the single ply web has a MIU value from about 0.550 to about 0.700.

15. The rolled tissue product of claim 10, wherein the single ply web has a single wire probe mean deviation of Surface Thickness (SMD) from about 1.5 to about 3.5 microns.

* * * * *